United States Patent [19]

Crisp et al.

[11] Patent Number: 4,997,239

[45] Date of Patent: Mar. 5, 1991

[54] WEB-DISPENSING APPARATUS

[75] Inventors: David J. Crisp; Clive A. Roux, both of London, England

[73] Assignee: The Wellcome Faoundation Limited, London, England

[21] Appl. No.: 481,724

[22] Filed: Feb. 16, 1990

Related U.S. Application Data

[63] Continuation of Ser. No. 246,322, Sep. 20, 1988, abandoned.

[30] Foreign Application Priority Data

Sep. 21, 1987 [GB] United Kingdom ..... 8722189

[51] Int. Cl.[5] ..... B65H 19/00

[52] U.S. Cl. ..... 312/38

[58] Field of Search ..... 312/37-39

[56] References Cited

U.S. PATENT DOCUMENTS

| | | | |
|---|---|---|---|
| 807,722 | 12/1905 | Clawson | 312/38 X |
| 1,050,539 | 1/1913 | Hendrick | 312/38 |
| 1,418,219 | 5/1922 | Wheeler | 312/38 |
| 1,426,121 | 8/1922 | Steiner | 312/38 |
| 1,765,505 | 6/1930 | Steiner et al. | 312/38 |
| 1,843,658 | 2/1932 | Addler | 312/38 |
| 1,916,542 | 7/1933 | Trewhitt et al. | 312/38 |
| 2,295,955 | 9/1942 | Page | 312/38 X |
| 3,222,112 | 12/1965 | Bahnsen . | |
| 3,574,431 | 4/1971 | Henderson . | |
| 4,270,818 | 6/1981 | McCabe . | |
| 4,718,588 | 1/1988 | Arabian et al. | 312/38 |
| 4,818,042 | 4/1989 | Arabian et al. | 312/38 |

*Primary Examiner*—Joseph Falk

*Attorney, Agent, or Firm*—Nixon & Vanderhye

[57] ABSTRACT

A towel-dispensing cabinet has a loop of towel web (1) available for a user, a substantial part (12) of the loop being removably contained within the cabinet. The length of exposed web (between C and D) can be increased by a user drawing web material from the concealed loop part (12) against the urging of a gravity-urged roller (9).

6 Claims, 4 Drawing Sheets

WEB-DISPENSING APPARATUS

This is a continuation of application Ser. No. 07/246,322, filed Sept. 20, 1988 now abandoned.

This invention relates to a web-dispensing apparatus which has particular, but not exclusive, value for use with towel material in a washroom or the like.

BACKGROUND OF THE INVENTION

It is known to provide towel-dispensing cabinets in which a loop of web material extends between a reservoir of clean web material and a collection region for used web material. Conventionally this loop hangs down below the cabinet and provides a sufficient length of relatively freely supported web material to permit a user to dry hands and/or face on the web. By pulling downwardly on the web material leaving the cabinet, a user can draw fresh material into the loop as used material leaves the other end of the loop and is drawn back into the cabinet to pass to the collection region.

A substantial exposed loop of web material can be unsightly and this invention relates to an improved web-dispensing apparatus which although providing a freely supported loop when required, houses a substantial part of the loop within the cabinet when not being used.

SUMMARY OF THE INVENTION

In its broadest aspect, a web-dispensing apparatus comprises a cabinet exhibiting a loop of web material extending between a reservoir of clean web material and a collection point for used web material and is characterised in that means is provided to removably contain a substantial part of the loop within the cabinet.

Desirably, the means to removably contain a loop part in the cabinet comprises a loop-defining roller supported by a half-turn of the web material and mounted within the cabinet so that its axis can move in the direction of the web immediately upstream and downstream of the roller. The loop-defining roller can tension the web parts upstream and downstream of it by virtue of its weight and/or by virtue of spring urging.

The reservoir of clean web material can be a roll or a zig-zag folded pack and the collection point can include one or more spools to form a roll of used material or a region in which a zig-zag folded pack can form (or reform).

The web material can be woven or non-woven and may be laundered for re-use or used just once. A paper web material is particularly preferred.

BRIEF DESCRIPTION OF THE DRAWINGS

Embodiments of web-dispensing apparatus in accordance with the invention will now be described, by way of example, with reference to the accompanying drawings, in which.

DETAILED DESCRIPTION OF THE INVENTION

Figure 1:
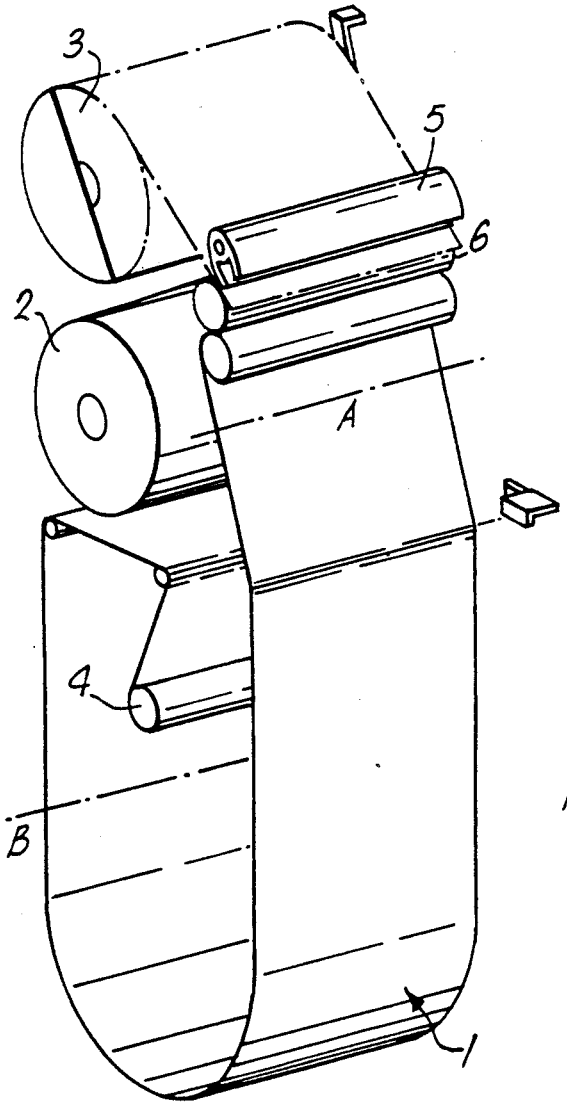
Fig. 1. PRIOR ART
FIG. 1 shows a schematic drawing of a prior towel-dispensing unit of the kind described in our copending European Application 88306740.7.

The unit shown in FIG. 1 has first and second rolls 2, 3 of fresh web material which provides a loop 1 on its way to a wind-up spool 4. The cabinet is not shown in any of FIGS. 1 to 4, but, so far as the unit of FIG. 1 is concerned, would leave exposed the length of the loop 1 between the chain lines A and B. Details of this unit and in particular the procedure whereby the trailing end of roll 2 is joined to the leading end of roll 3 are fully described in the description filed with our European Application 88305740.7. A spring unit 5 in engagement with roll 6 (see also FIG. 5) provides the nip in which joining of the trailing and leading ends occurs.

Figure 2:
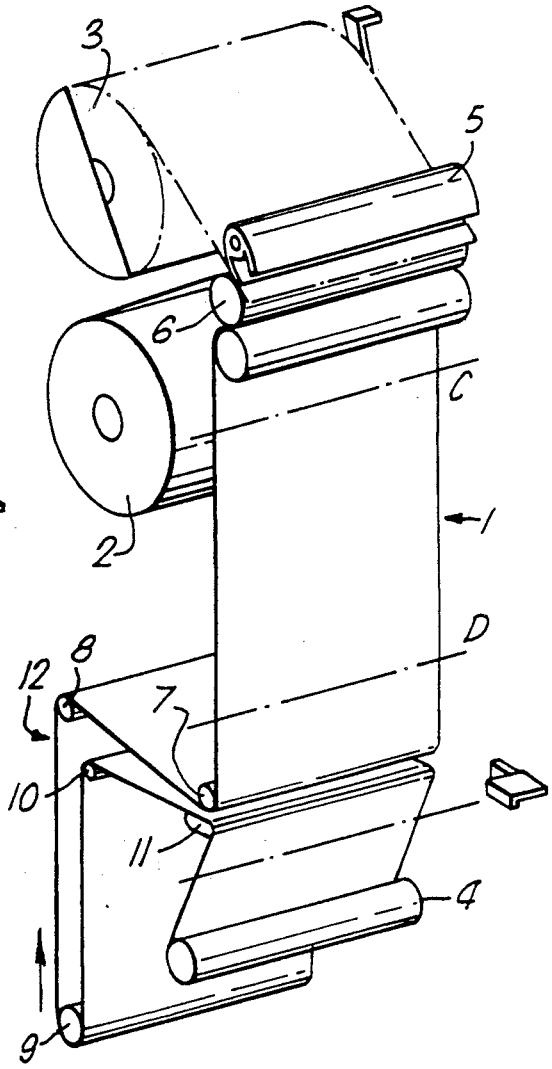
FIG. 2, 3 and 4 show schematic drawings of three units in accordance with this invention.

The main feature of difference between the units shown in FIGS. 1 and 2 is that in FIG. 2 most of the loop 1 is removably housed within the cabinet of the unit so that only the part between chain lines C and D is normally exposed. The loop part 12, defined around rollers 7, 8, 9 and 10 and bar 11, is normally drawn into the cabinet by the weight of the roller 9 but when a user wishes to expose a substantially free length of web he/she can draw the required material from the loop part 12 and when the web is released, the loop part 12 will be retracted back into the cabinet. As in the embodiment of FIG. 1 fresh web material can be drawn into the loop from the roll 2 or 3 as and when required and a corresponding amount of web material is taken out of the loop by being wound up on the wind-up spool 4.

Figure 5:
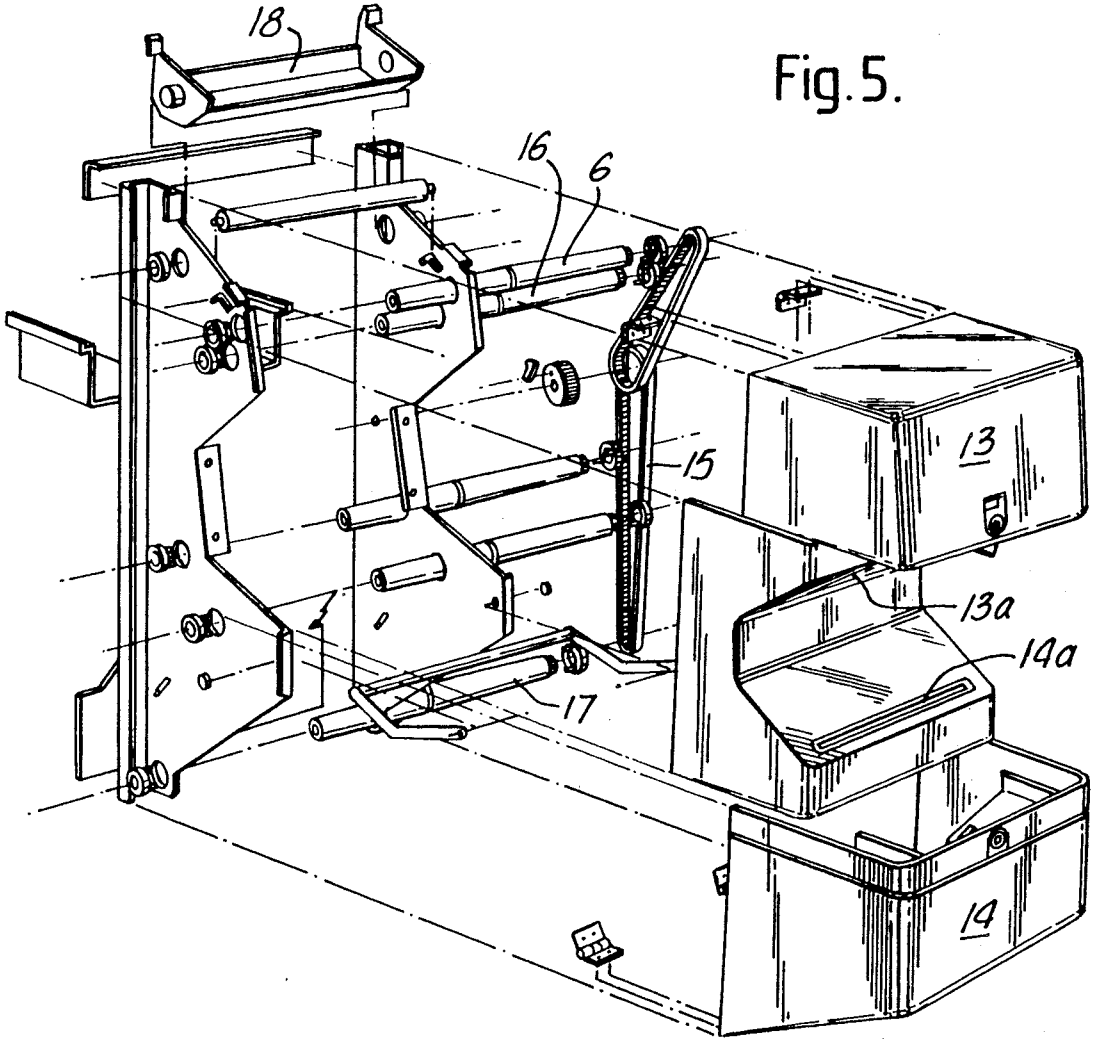
FIG. 5 is a partially exploded view of a towel-dispensing cabinet similar to that shown in FIG. 2.

FIG. 5 shows the mechanism of FIG. 2 in more detail and shows cabinet parts 13, 14 which leave the web exposed between edges 13 a, 14*a* and a belt 15 or conveying drive from a nip roller 16 at the upstream end of the loop to a web-driving roller 17 engaging the web on the wind-up roll formed on the spool 4. A cradle 18 for supporting the roll 3 is also shown in FIG. 5.

Figure 3:
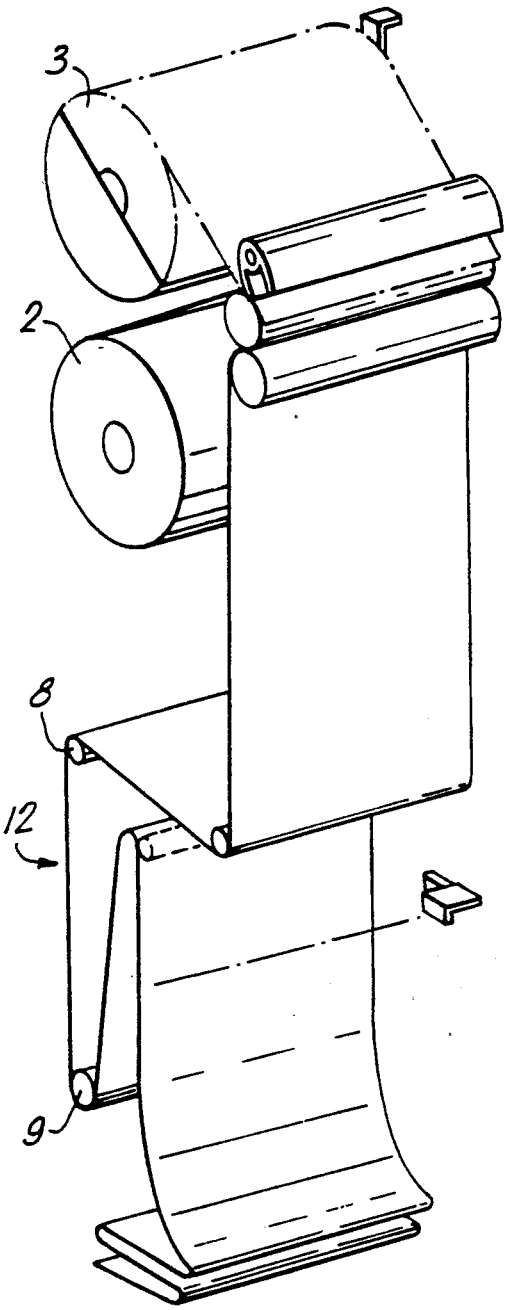

FIG. 3 shows a variant of FIG. 2 in which the used material in the collection point is in zig-zag form.

Figure 4:
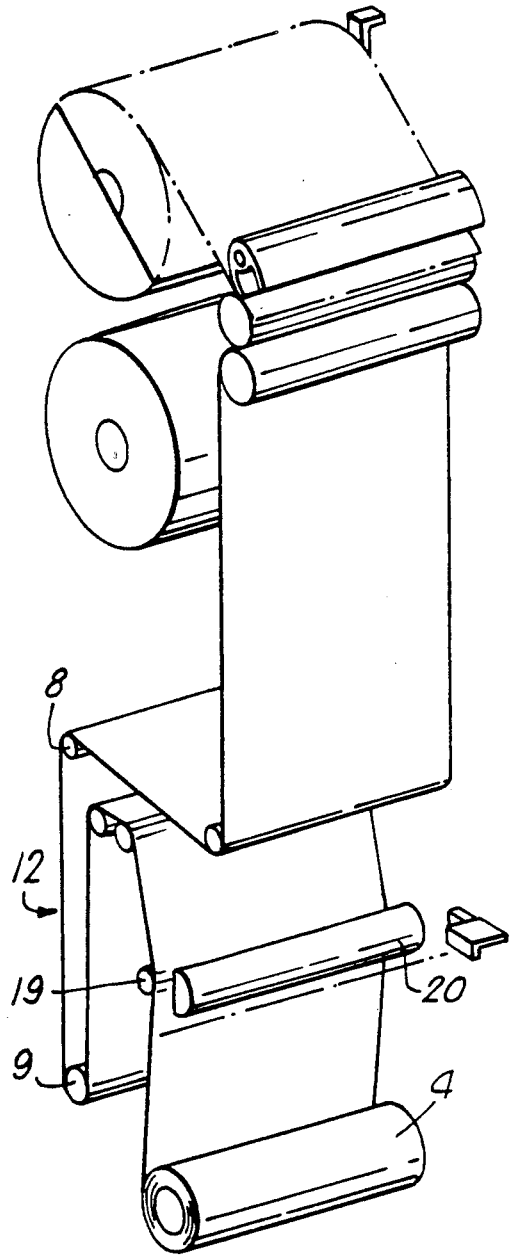

FIG. 4 shows how a second wind-up roll of web can be formed upstream of a first when the first has reached a desired maximum size. The second wind-up roll will be formed around split core halves 19, 20 which are pressed around the web (by a mechanism not shown) when winding of the second wind-up roll is to commence. A cutting means (not shown) would sever the web between the fully wound first wind-up roll and the closed-together core halves 19, 20 to ensure the first roll is not unwound in the winding-up of the second roll.

The length of web in the loop part 12 would normally remain substantially the same provided there is no significant shrinkage/stretching of web in use and provided the rate at which fresh web is pulled into the loop equals the rate at which it is removed from the downstream end of the loop. Any variation in the length of the loop part 12 will be manifest by a change in rest height of the roller 9 and this can be periodically checked by a service engineer. Should a greater web length be required in the loop part 12 than can be accommodated with a single loop-tensioning roller 9, a pair of such rollers can be used side-by-side so that the closed end of the loop part 12 has a crosssection more like a "W" than a "U".

Figure 6:
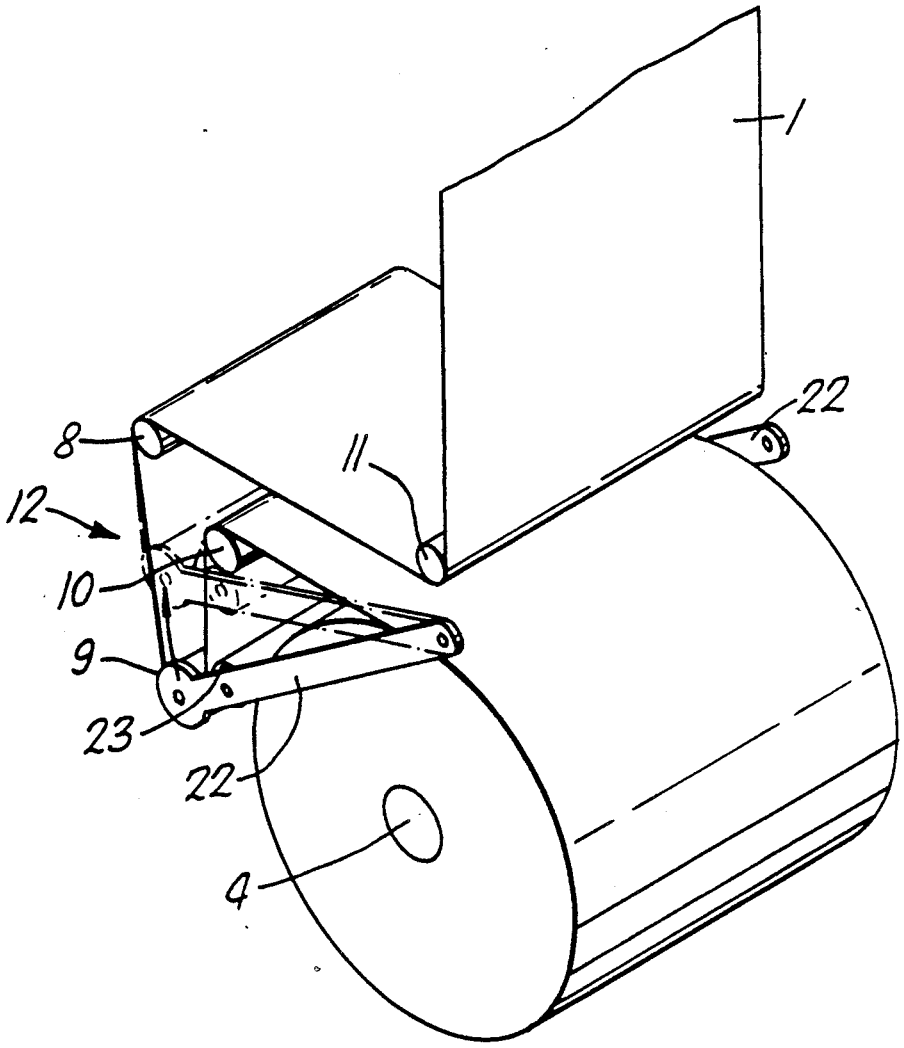
FIG. 6 shows a portion of a modification to the construction shown in FIGS. 2 and 5.

FIG. 6 shows a modification which incorporates brake means to prevent a user unwinding used web material from the roll on the wind-up spool 4.

The roller 9 shown in FIG. 6 is carried on a pair of arms 22 which arms also support a locking bar 23. When the loop part 12 is fully withdrawn from the cabinet the arms 22 have been drawn up to their uppermost position by engagement of the loop part 12 with the roller 9 to a point where the bar 23 brakes further rotation of the roller 10 and thereby traps web material against further withdrawal from the cabinet.

We claim:

1. A web-dispensing apparatus, comprising:

a cabinet;

a reservoir of clean web material;

a web-collection point for collecting used web material;

a web-guiding means disposed within said cabinet and below said reservoir for guiding said web material from said reservoir to said web-collection point, said web-guiding means including at least three roller means, said at least three roller means being disposed such that said web material after leaving said reservoir and prior to arriving at said web collection point contacts said at least three roller means and is urged into a substantially U-shaped configuration by said roller means; and brake means for preventing the user withdrawing used web material from said web-collection point, said brake means comprising a pair of arms which are upwardly movable as web material extending through said web-guiding means is drawn out of said cabinet, said pair of arms supporting a locking member engageable with one of said three roller means when said arms are in their uppermost position to prevent rotation of said roller means and withdrawal of used web material through the web-guiding means.

2. Apparatus as claimed in claim 1, in which one of said at least three roller means urges said web material into said substantially U-shaped configuration by means of its weight.

3. Apparatus as claimed in claim 1, in which one of said at least three roller means urges said web material into said substantially U-shaped configuration by spring urging.

4. Apparatus as claimed in claim 1, in which the reservoir of clean material is a roll and the collection point includes a spool to form a roll of used material.

5. Apparatus as claimed in claim 1, in which a roller is driven by web material leaving the reservoir and rotation of said roller is used to drive a member removing used web after it has passed through said web-guiding means.

6. Apparatus as claimed in claim 5, in which said web-driven roller is a nip roller upstream of said web-guiding means and said member removing web material is a web-driving roller engaging a roll of used web material at said collection point.

* * * * *